US007591248B2

(12) United States Patent
Mizui et al.

(10) Patent No.: US 7,591,248 B2
(45) Date of Patent: Sep. 22, 2009

(54) FUEL INJECTION SYSTEM

(75) Inventors: Hiroshi Mizui, Odawara (JP); Ryoji Ehara, Odawara (JP)

(73) Assignee: Mikuni Corporation, Tokyo (JP)

( * ) Notice: Subject to any disclaimer, the term of this patent is extended or adjusted under 35 U.S.C. 154(b) by 187 days.

(21) Appl. No.: 10/588,151

(22) PCT Filed: Feb. 22, 2005

(86) PCT No.: PCT/JP2005/002779

§ 371 (c)(1),
(2), (4) Date: Aug. 1, 2006

(87) PCT Pub. No.: WO2005/083258

PCT Pub. Date: Sep. 9, 2005

(65) Prior Publication Data

US 2007/0125345 A1 Jun. 7, 2007

(30) Foreign Application Priority Data

Mar. 2, 2004 (JP) ..... 2004-057327

(51) Int. Cl.
*F02M 55/02* (2006.01)
*F02M 37/20* (2006.01)

(52) U.S. Cl. ..... 123/468; 123/509; 123/514; 123/516; 123/518

(58) Field of Classification Search ..... 123/516, 123/518, 520, 519, 468, 509, 514
See application file for complete search history.

(56) References Cited

U.S. PATENT DOCUMENTS 5,579,740 A * 12/1996 Cotton et al. ..... 123/516
5,855,197 A * 1/1999 Kato ..... 123/516
6,076,509 A * 6/2000 Kyuma ..... 123/516

(Continued)

FOREIGN PATENT DOCUMENTS

JP 59-71951 5/1984

(Continued)

OTHER PUBLICATIONS

Japanese Office Action (Notice of Rejection) issued Apr. 21, 2009 in corresponding Japanese Application No. 2006-510417(with partial English translation).

*Primary Examiner*—Stephen K Cronin
*Assistant Examiner*—J. Page Hufty
(74) *Attorney, Agent, or Firm*—Wenderoth, Lind & Ponack, L.L.P.

(57) ABSTRACT

In a fuel injection system, a fuel tank is disposed below an electronically controlled fuel injection apparatus. A fuel reservoir chamber for supplying fuel from the fuel tank is disposed above the electronically controlled fuel injection apparatus, and the fuel stored in the fuel reservoir chamber is supplied to the electronically controlled fuel injection apparatus via a fuel supply passage. The fuel reservoir chamber and the fuel tank are connected by a first fuel return passage through which vapor is ejected and fuel in the fuel reservoir chamber overflows. A second fuel return passage for returning surplus fuel from the electronically controlled fuel injection apparatus is connected to either of the fuel reservoir chamber and the first fuel return passage at the position above the connecting position at which the fuel reservoir chamber connects with the first fuel return passage.

20 Claims, 6 Drawing Sheets

U.S. PATENT DOCUMENTS

| | | | | |
|---|---|---|---|---|
| 6,736,110 | B2 * | 5/2004 | Kato | 123/456 |
| 6,739,318 | B2 * | 5/2004 | Nomura | 123/461 |
| 2004/0020475 | A1 | 2/2004 | Hashimoto et al. | |

FOREIGN PATENT DOCUMENTS

| | | |
|---|---|---|
| JP | 59-159777 | 10/1984 |
| JP | 62-197766 | 12/1987 |
| JP | 1-114972 | 8/1989 |
| JP | 8-296526 | 11/1996 |
| JP | 2002-155828 | 5/2002 |
| JP | 2003-42032 | 2/2003 |

* cited by examiner

FUEL INJECTION SYSTEM

BACKGROUND OF THE INVENTION

1. Field of the Invention

The present invention relates to a fuel injection system wherein the fuel tank is located below the electronically controlled fuel injection apparatus.

2. Description of the Related Art

Conventionally, an electronically controlled fuel injection apparatus is known to supply fuel to an engine. In general, an electronically controlled fuel injection apparatus is located below a fuel tank, and there is a case that the fuel tank and the electronically controlled fuel injection apparatus are connected by a fuel supply passage, and fuel is supplied to the electronically controlled fuel injection apparatus from the fuel tank by gravity-drop utilizing head difference.

When ambient temperature of an engine rises, vapor is generated in the fuel in the fuel tank or the fuel supply passage. Then, fuel which contains vapor is supplied to the electronically controlled fuel injection apparatus. When vapor is contained in the fuel which is injected from the electronically controlled fuel injection apparatus, an appropriate amount of fuel cannot be injected into an intake passage. Then, problems occur, such that specific air fuel ratio cannot be obtained or malfunctions of restarting occur.

It is desirable that vapor is not contained in the fuel which is supplied to the electronically controlled fuel injection apparatus. However, practically, it is impossible to completely prevent vapor from being generated in the fuel which is supplied to an electronically controlled fuel injection apparatus. A conventional configuration to obtain an appropriate air fuel ratio even when fuel which contains vapor is supplied to an electronically controlled fuel injection apparatus is disclosed in Japanese Patent laid-open 2003-42032 (page 3, FIG. 1). In this conventional configuration, a fuel return passage is disposed between an electronically controlled fuel injection apparatus and a fuel tank, and more fuel than the amount to be injected is supplied to the electronically controlled fuel injection apparatus from the fuel tank. Vapor is contained in the supplied fuel at high temperature. Vapor is separated from the fuel inside the electronically controlled fuel injection apparatus, namely, fuel for injection goes downwards and vapor goes upwards. The separated vapor and surplus fuel which was not used by the electronically controlled fuel injection apparatus are returned to the fuel tank through the fuel return passage. In this manner, even when vapor is contained in the fuel which is supplied to an electronically controlled fuel injection apparatus, the fuel to be injected to an engine does not contain vapor and a stable air fuel ratio can be obtained by mixing vapor into the surplus fuel which is returned from the electronically controlled fuel injection apparatus.

Conventionally, with a motorcycle, the fuel tank is disposed between the knees or below the seat, and an electronically controlled fuel injection apparatus is disposed below the fuel tank. Then, fuel is supplied to the electronically controlled fuel injection apparatus from the fuel tank by gravity-drop utilizing head difference. With this fuel supply method utilizing head difference, there is an advantage of cost reduction by not having a fuel supply means to supply fuel to an electronically controlled fuel injection apparatus. Further, there is an advantage that vapor moves upwards inside the fuel supply passage and returns to the fuel tank automatically.

Depending on the purpose or the layout of an engine, there is a case that the fuel tank has to be located below the electronically controlled fuel injection apparatus. In the case that a fuel tank is located below an electronically controlled fuel injection apparatus, fuel has to be transported upwards to the electronically controlled fuel injection apparatus from the fuel tank via a fuel supply passage by utilizing a fuel pump.

In the case that fuel is transported to an electronically controlled fuel injection apparatus from a fuel tank utilizing a fuel pump, fuel transported upwards by the fuel pump returns to the fuel tank via the fuel supply passage when the engine stops, due to lack of stability of a check valve of the fuel pump. Therefore, there arises a problem that fuel supply is delayed when the engine is started or restarted, or that the ease of starting the engine is worsened due to vapor remaining within passages. Further, since the electronically controlled fuel injection apparatus is disposed above the fuel tank, when vapor is contained in the fuel in the fuel supply passage which connects the electronically controlled fuel injection apparatus and the fuel tank, vapor may move upwards through the fuel supply passage, and a large amount of vapor may accumulate in the electronically controlled fuel injection apparatus. Therefore, there arises a problem that fuel containing vapor is injected from the electronically controlled fuel injection apparatus, and an appropriate air fuel ratio cannot be obtained.

The present invention was devised in view of the abovementioned problems. The object is to provide a fuel injection system which can inject an appropriate amount of fuel from an electronically controlled fuel injection apparatus while returning vapor existing somewhere in the fuel passages, even in the condition that the fuel tank is disposed below an electronically controlled fuel injection apparatus.

SUMMARY OF THE INVENTION

To achieve the abovementioned object, the fuel injection system of the present invention comprises a fuel tank, an electronically controlled fuel injection apparatus which is located above the fuel tank, a fuel reservoir chamber which is located above the electronically controlled fuel injection apparatus, a fuel introduction passage which connects the fuel tank and the fuel reservoir chamber, a fuel pump which introduces fuel from the fuel tank to the fuel reservoir chamber via the fuel introduction passage, a first fuel return passage which connects the fuel reservoir chamber and the fuel tank and returns fuel overflowing from the fuel reservoir chamber and vapor to the fuel tank, a fuel supply passage which connects the fuel reservoir chamber and the electronically controlled fuel injection apparatus, a filter which is disposed at some midpoint of the fuel supply passage or in the fuel reservoir chamber for eliminating vapor from fuel passing through the fuel supply passage, and a second fuel return passage which returns surplus fuel from the electronically controlled fuel injection apparatus and connects the electronically controlled fuel injection apparatus with one of the fuel reservoir chamber and the first fuel return passage at a position above the connecting position at which the fuel reservoir chamber connects with the first fuel return passage.

The fuel injection system of the present invention comprises an inner space which is formed in the filter, and a branch passage which branches from some midpoint of the second fuel return passage at a position below the connecting position of the first fuel return passage and the fuel reservoir chamber, and the branch passage and the fuel supply passage are connected with the inner space of the filter, and the branch passage is horizontal or declined from the branching position from the second fuel return passage towards the connecting position with the inner space. In the present invention, the connecting position at which the branch passage connects with the second fuel return passage is the highest position, and the connecting position at which the fuel supply passage on the downstream side of the inner space connects with the electronically controlled fuel injection apparatus is the lowest position in the route from the branch passage through the inner space of the filter to the fuel supply passage on the downstream side of the inner space, and the route from the highest position to the lowest position does not have a portion where the height is reversed (i.e. does not have a portion that rises in the direction from the highest position to the lowest position). In the present invention, the inner diameter of the second fuel return passage above the branching position from the branch passage is equal to or larger than 12 millimeters. In the present invention, the inner diameter of the second fuel return passage below the branching position at which the branch passage branches from the second fuel return passage is smaller than that of the second fuel return passage above the branching position. In the present invention, a filter which does not allow foreign particles to pass through but allows vapor to pass through is disposed at the second fuel return passage above the connecting position at which the fuel reservoir chamber connects with the first fuel return passage. In the present invention, the fuel supply passage projects and opens above the fuel level in the fuel reservoir chamber, and a fuel inlet opening which is formed at the fuel supply passage below the fuel level in the fuel reservoir chamber is covered by a filter. In the present invention, a filter which does not allow foreign particles to pass through but allows vapor to pass through is attached to the projected opening portion on the upstream side of the fuel supply passage.

With the present invention, fuel in the fuel tank is stored in the fuel reservoir chamber which is disposed above the electronically controlled fuel injection apparatus by a fuel pump. Then, fuel is supplied to the electronically controlled fuel injection apparatus from the fuel reservoir chamber utilizing head difference. Further, the upper portion of the fuel reservoir chamber and the upper portion of the fuel tank is connected by the first fuel return passage. With this structure, vapor can be ejected from the fuel reservoir chamber to the fuel tank via the first fuel return passage, even when vapor is contained in the fuel in the fuel introduction passage from the fuel tank to the fuel reservoir chamber or the fuel stored in the fuel reservoir chamber. Therefore, vapor contained in the fuel supplied from the fuel reservoir chamber to the electronically controlled fuel injection apparatus can be reduced. In this manner, an appropriate air fuel ratio can be obtained by greatly eliminating vapor from the fuel supplied to the electronically controlled fuel injection apparatus, even when the fuel tank is disposed below the electronically controlled fuel injection apparatus.

Further, with the present invention, the electronically controlled fuel injection apparatus and some midpoint of the first fuel return passage are connected by the second fuel return passage, and some midpoint of the second fuel return passage is arranged to be above the connecting position at which the fuel reservoir chamber connects with the first fuel return passage. Further, the branch passage which branches from some midpoint of the second fuel return passage at a position below the connecting position at which the fuel reservoir chamber connects with the first fuel return passage is disposed, and the branch passage is connected with some midpoint of the fuel supply passage. The branch passage is arranged to be horizontal or declining at the connecting position at which the branch passage connects with the second fuel return passage. With this structure, vapor contained in the surplus fuel ejected from the electronically controlled fuel injection apparatus to the second fuel return passage can be returned to the fuel tank after moving upwards in the second fuel return passage, without entering into the branch passage. On the other hand, a part of the surplus fuel ejected from the electronically controlled fuel injection apparatus to the second fuel return passage is introduced to the branch passage after eliminating vapor at the branching position at which the branch passage branches from the second fuel return passage. The vapor-eliminated surplus fuel flows into the fuel supply passage from the branch passage. Then, the surplus fuel can be re-supplied in a circulatory manner as the supply fuel to the electronically controlled fuel injection apparatus. As mentioned above, the surplus fuel ejected from the electronically controlled fuel injection apparatus does not return to the fuel tank. Therefore, compared with a system which returns the surplus fuel ejected from the electronically controlled fuel injection apparatus to the fuel tank, fuel can be efficiently re-supplied.

The branch passage and the inner space of the filter which is a part of the fuel supply passage are connected, and the surplus fuel from the branch passage flows towards the fuel supply passage at the downstream side. Therefore, even when vapor is accumulated at the filter and generates resistance against the fuel flow for passing through the filter, the flow of the supply fuel to pass through the filter can be smoothed by the flow of the surplus fuel through the inner space. Further, throughout the route from the branch passage through the inner space of the filter to the fuel supply passage at the downstream side of the inner space, there is no portion where the height is reversed from the upper position to the lower position (i.e., there is no rising portion in the direction from the upper position to the lower position). Therefore, the vapor moves upwards and can return from the branch passage to the fuel tank via the second fuel return passage and the first fuel return passage, even when vapor is generated anywhere in the branch passage, the inner space or the fuel supply passage at the downstream side.

In either case with a branch passage or without a branch passage, the top portion of the fuel supply passage has an opening portion above the fuel level while passing through the fuel reservoir chamber. With this structure, the vapor generated in the fuel supply passage in a non-operational state can be ejected above the fuel level in the fuel reservoir chamber via the fuel supply passage, and accumulation of vapor to the fuel supply passage can be prevented. Therefore, ease of restarting can be improved.

DESCRIPTION OF THE PREFERRED EMBODIMENTS

A fuel tank is located below an electronically controlled fuel injection apparatus, and a fuel reservoir chamber is disposed above the electronically controlled fuel injection apparatus. Then, fuel is transported upwards to the fuel reservoir chamber from the fuel tank by a fuel pump, and fuel is supplied to the electronically controlled fuel injection apparatus from the fuel reservoir chamber by head difference.

The First Embodiment

Next, the present invention is explained with reference to the drawings.

Figure 1:
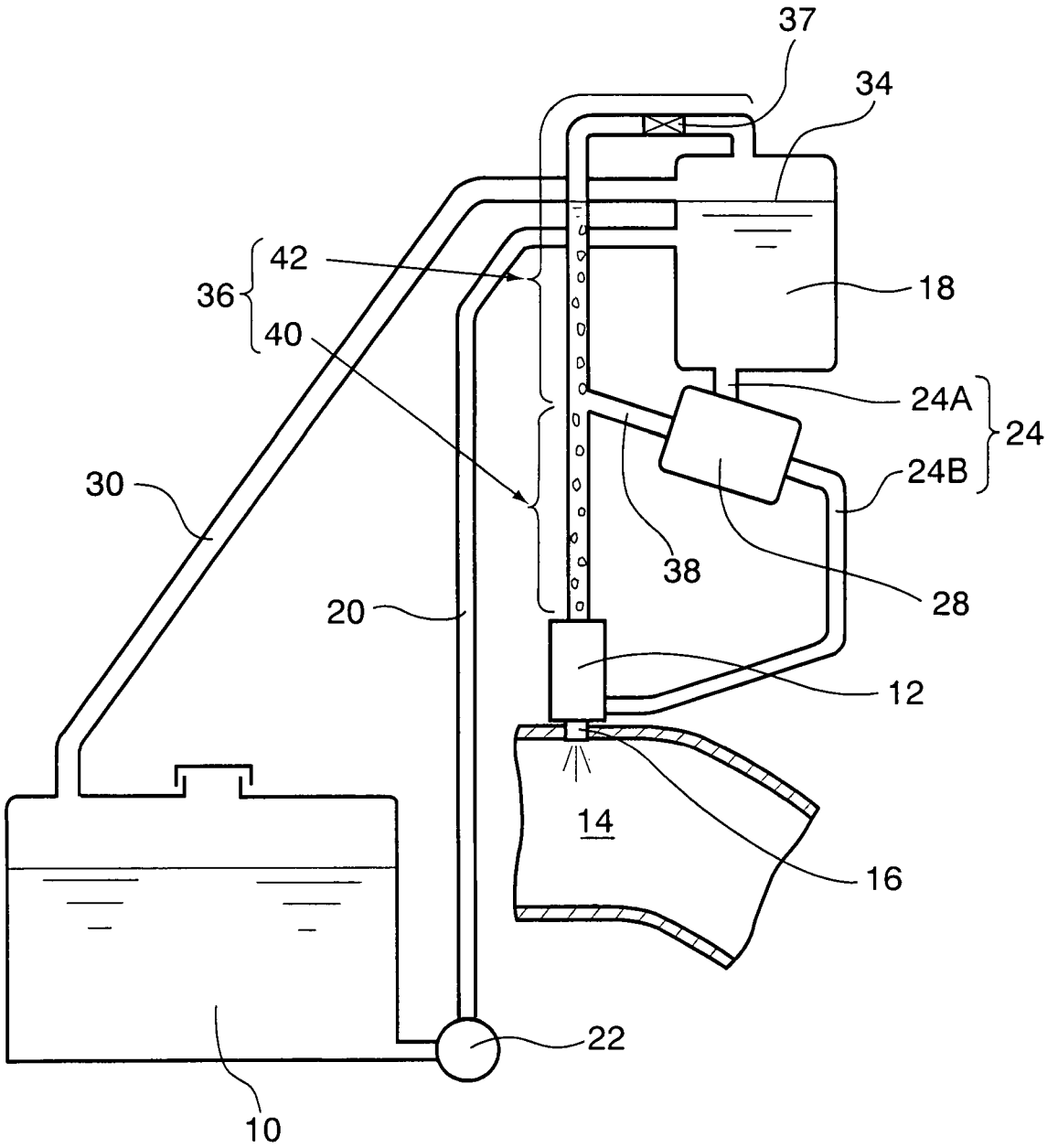
FIG. 1 is a schematic drawing showing a first embodiment of a fuel injection system of the present invention.
Figure 2:
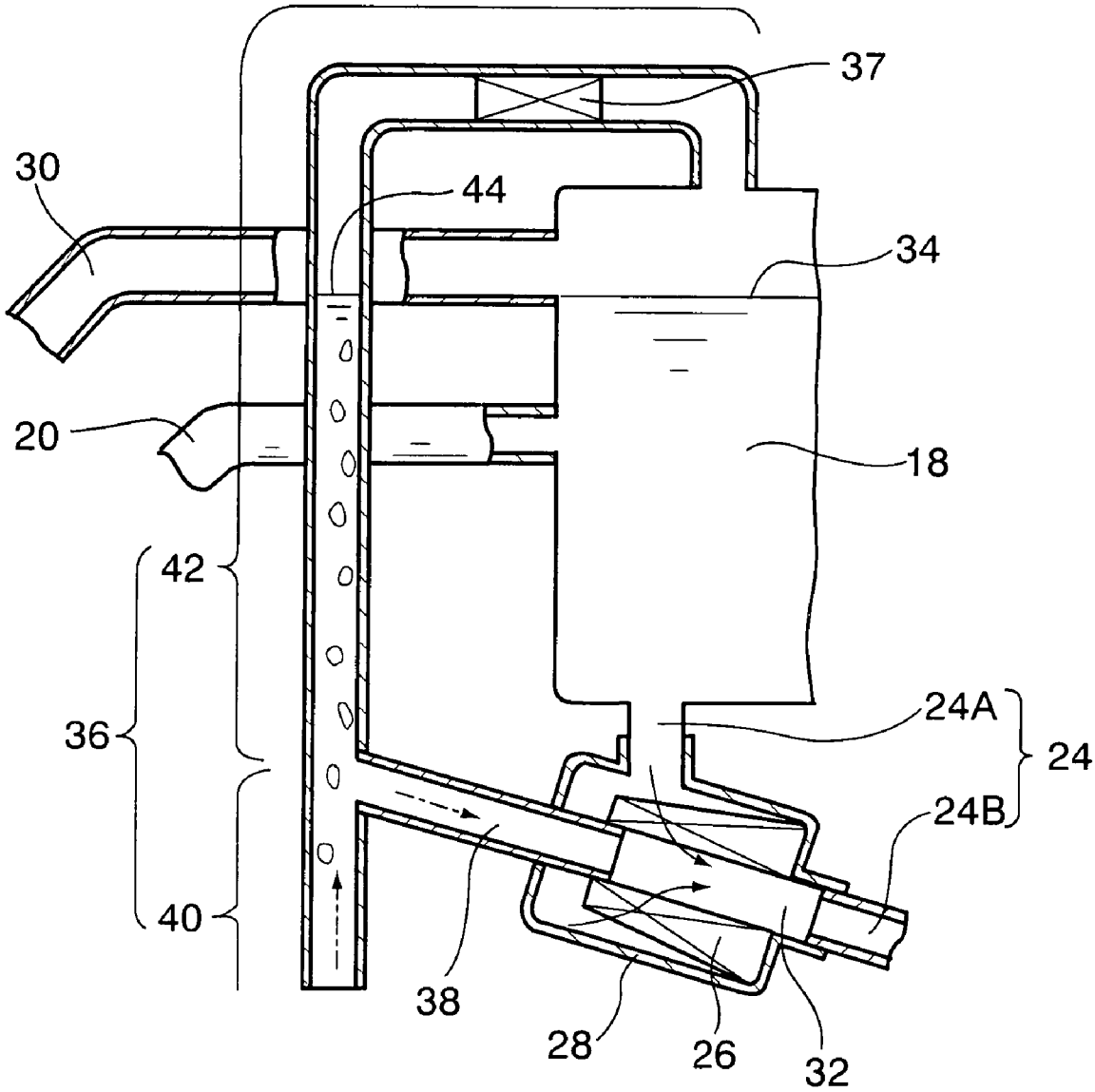
FIG. 2 is an enlarged sectional view of a main part of FIG. 1.

FIG. 1 is a schematic drawing of a fuel injection system of the present invention. FIG. 2 is an enlarged sectional view of a main part of FIG. 1. The present invention is devised on the precondition that a fuel tank 10 is located below an electronically controlled fuel injection apparatus 12. The electronically controlled fuel injection apparatus 12 injects fuel into an intake passage 14 which is connected to an engine (not shown in drawings). The electronically controlled fuel injection apparatus 12 has an injection pump (not shown in drawings), and a vapor separation chamber (not shown in drawings). With the electronically controlled fuel injection apparatus 12, vapor contained in the fuel introduced inside is collected upwards, and fuel from which vapor is eliminated is injected from a fuel injection nozzle 16. Then, surplus fuel and vapor are returned outside by a pumping effect of air bubbles (i.e. vapor). The electronically controlled fuel injection apparatus 12 is not limited to the abovementioned structure as long as a large amount of fuel is introduced and a part of the fuel is injected while surplus fuel is returned.

In the present invention, a fuel reservoir chamber 18 is disposed above the electronically controlled fuel injection apparatus 12. The middle height position of the fuel reservoir chamber 18 and the lower position of the fuel tank 10 are connected by a fuel introduction passage 20. A fuel pump 22 is disposed at some midpoint of the fuel introduction passage 20. Fuel in the fuel tank 10 is introduced to the fuel reservoir chamber 18 via the fuel introduction passage 20 by the fuel pump 22. Here, it is also possible to dispose the fuel pump 22 in the fuel tank 10.

The lower position (for example, the bottom portion) of the fuel reservoir chamber 18 and the electronically controlled fuel injection apparatus 12 are connected by a fuel supply passage 24. The fuel supply passage 24 is basically arranged to decline from the fuel reservoir chamber 18 towards the electronically controlled fuel injection apparatus 12, although it is possible to partially include a horizontal portion. With the present invention, since the fuel reservoir chamber 18 is located above the electronically controlled fuel injection apparatus 12, fuel is supplied to the electronically controlled fuel injection apparatus 12 from the fuel reservoir chamber 18 by gravity-drop utilizing head difference.

A filter body 28, in which a filter 26 for eliminating vapor is disposed, is disposed at some midpoint of the fuel supply passage 24. Here, the fuel supply passage 24 consists of an upper fuel supply passage 24A which is on the upstream side of the filter body 28, and a lower fuel supply passage 24B which is on the downstream side of the filter body 28. The filter 26 is provided for preventing vapor from passing through. The filter 26 shown in FIG. 2 is shaped as a hollow cylinder with an inner space 32. Fuel flows into the inner space 32 from the outer surface of the filter 26 through the thickness of the cylindrical shape. The inner space 32 of the filter 26 is connected to the lower fuel supply passage 24B. Fuel passing through the filter 26 moves towards the electronically controlled fuel injection apparatus 12 via the lower fuel supply passage 24B. In FIG. 1, the lower fuel supply passage 24B, connects with the filter 26 at the highest position of the lower fuel supply passage 24B, and the lower fuel supply passage 24B connects with the electronically controlled fuel injection apparatus 12 at the lowest position of the lower fuel supply passage 24B. The lower fuel supply passage 24B is arranged to not have a portion that rises so that the range from the highest position to the lowest position does not have a portion where the height is reversed (i.e., does not have a rising portion in the direction from the highest to lowest positions).

The side wall of the upper position of the fuel reservoir chamber 18 and the upper portion of the fuel tank 10 are connected by a first fuel return passage 30. The first fuel return passage 30 is basically arranged to decline from the fuel reservoir chamber 18 towards the fuel tank 10, although it is possible to partially include a horizontal portion. The first fuel return passage 30 is provided for returning surplus fuel in the fuel reservoir chamber 18 to the fuel tank 10 by overflowing, when the height of the fuel level 34 becomes higher than the connecting position at which the first fuel return passage 30 connects with the fuel reservoir chamber. It is also provides for returning vapor in the fuel reservoir chamber 18 to the fuel tank 10. The inner diameter of the first fuel return passage 30 is preferably large enough so that the overflowing fuel does not clog the cross-section. When ambient temperature of an engine is high, vapor is generated in the fuel flowing in the fuel introduction passage 20 or the fuel stored in the fuel reservoir chamber 18. However, vapor is ejected above the fuel level 34 in the fuel reservoir chamber 18. Then, vapor returns to the fuel tank 10 through the first fuel return passage 30.

In the present invention, the upper position of the electronically controlled fuel injection apparatus 12 and the upper position of the fuel reservoir chamber 18, which is above the connecting position at which the fuel reservoir chamber 18 connects with the first fuel return passage 30, are connected by a second fuel return passage 36. Namely, the second fuel return passage 36 includes a high portion which is higher than the connecting position of the fuel reservoir chamber 18 with the first fuel return passage 30. A filter 37 is disposed at some midpoint of the high portion of the second fuel return passage 36. The filter 37 captures foreign particles, but allows vapor to pass through. The filter 37 is provided for preventing fuel which includes foreign particles in the fuel reservoir chamber 18 from flowing into the electronically controlled fuel injection apparatus 12 from the second fuel return passage 36 via the later-mentioned branch passage and the fuel supply passage 24, when a roll-over of a vehicle occurs.

Figure 3:
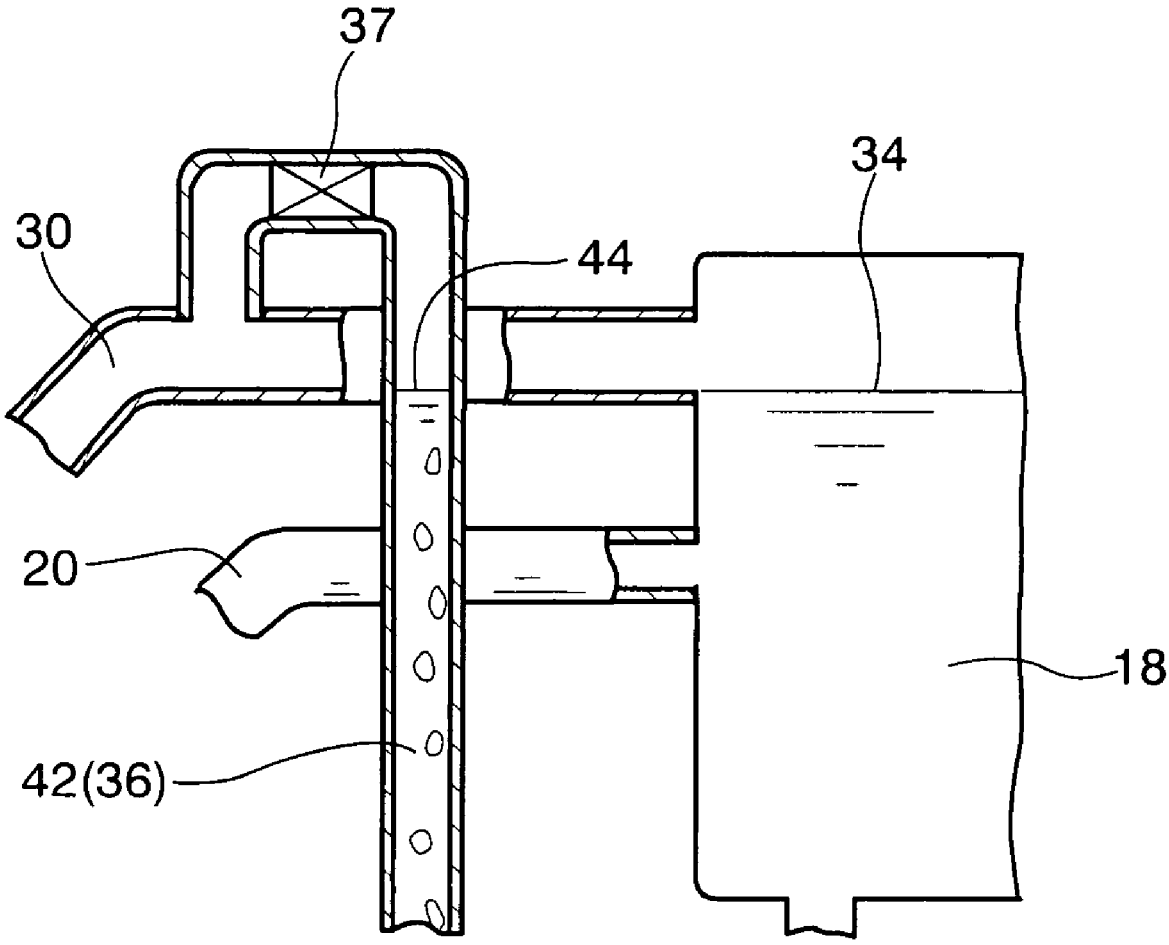
FIG. 3 is a sectional view of a modified embodiment of FIG. 2.

Here, as shown in FIG. 3, the second fuel return passage 36 is connected with the first fuel return passage 30 instead of with the upper portion of the fuel reservoir chamber 18. In this case, the connecting position at which the first fuel return passage 30 connects with the second fuel return passage 36 is higher than the connecting position at which the fuel reservoir chamber 18 connects with the first fuel return passage 30. In FIG. 3, as in FIG. 2, the filter 37, which captures foreign particles but allows vapor to pass through, is disposed at some midpoint of the high portion of the second fuel return passage 36. In addition, the second fuel return passage 36 can be connected with both the upper portion of the fuel reservoir chamber 18 and the upper portion of the first fuel return passage 30.

A branch passage 38 is disposed at some midpoint of the second fuel return passage 36. The end portion of the branch passage 38 which is at the opposite side of the second fuel return passage 36 is inserted and fitted into a cylindrical filter 26 in the filter body 28. By connecting the end portion of the branch passage 38 with the inner space 32 of the filter 26, the branch passage 38 is connected with the lower fuel supply passage 24B via the inner space 32. The position where the branch passage 38 branches from the second fuel return passage 36 is lower than the fuel level 34 in the fuel reservoir chamber 18, that is, the fuel level 34 within a normal up-and-down range. The branch passage 38 is basically arranged to decline from the connecting position with the second fuel return passage 36 towards the inner space 32 of the filter 26, although it is possible to partially include a horizontal portion. Namely, the branch passage 38 is arranged so that the highest position is the connecting position at which the branch passage 38 connects with the second fuel return passage 36, and the lowest position is the fitting position at which the branch passage 38 fits into the filter 26. The branch passage 38 is arranged to not have a portion that rises so that the range from the highest position to the lowest position does not have a portion where the height is reversed (i.e., does not have an inclining portion in the direction from the highest position to the lowest position). Further, it is preferred that the highest position of the inner space 32 of the filter 26 is at the connecting position side at which the inner space 32 connects with the branch passage 38, and the lowest position is at the connecting side at which the inner space 32 connects with the lower fuel supply passage 24B. In some cases, being horizontal is acceptable. The inner space 32 is arranged to not have a portion that rises so that the range from the highest position to the lowest position does not have a portion where the height is reversed (i.e., does not have a rising portion in the direction from the highest position to the lowest position).

Here, in the second fuel return passage 36, the portion from the electronically controlled fuel injection apparatus 12 to the branch position from the branch passage 38 is formed as a fuel vapor return passage 40, and the portion from the branch position from the branch passage 38 to the connecting position with the fuel reservoir chamber 18 is formed as a vapor return passage 42. Namely, at the top end, the fuel vapor return passage 40 is divided into the vapor return passage 42 and the branch passage 38. Here, it is preferred that the vapor return passage 42 is arranged to be straight and vertical above the fuel vapor return passage 40.

The inner diameter of the vapor return passage 42 is preferably equal to or larger than 12 mm. When the inner diameter of the vapor return passage 42 is small, vapor sandwiches the fuel. Then, a large amount of the fuel is returned to the fuel reservoir chamber 18 along with vapor through the vapor return passage 42. When the inner diameter of the vapor return passage 42 is equal to or larger than 12 mm, vapor does not sandwich the fuel and substantially only vapor can pass through the vapor return passage 42. Further, the inner diameter of the fuel vapor return passage 40 is preferably smaller than the inner diameter of the vapor return passage 42. With this structure, at the branch position of the vapor return passage 42 and the branch passage 38 at the top end of the fuel vapor return passage 40, vapor in the fuel vapor return passage 40 is introduced smoothly to the vapor return passage 42, and fuel which does not include vapor is introduced smoothly to the branch passage 38. Namely, a vapor separating function can be further performed.

Next, the function of the fuel injection system of the present invention is explained. Firstly, in the condition that the fuel reservoir chamber 18 is sufficiently filled with fuel, when fuel is injected from the injection nozzle 16 of the electronically controlled fuel injection apparatus 12 into the intake passage 14, fuel is supplied from the fuel reservoir chamber 18 to the electronically controlled fuel injection apparatus 12 via the fuel supply passage 24. Here, the fuel amount supplied from the fuel reservoir chamber 18 to the electronically controlled fuel injection apparatus 12 is determined by the head difference between the height of the fuel level 34 in the fuel reservoir chamber 18 and the injection nozzle 16 of the electronically controlled fuel injection apparatus 12. The fuel amount which is supplied from the fuel reservoir chamber 18 to the electronically controlled fuel injection apparatus 12 is set to be larger than the fuel amount which is injected from the injection nozzle 16 of the electronically controlled fuel injection apparatus 12 into the intake passage 14.

When the height of the fuel level 34 in the fuel reservoir chamber 18 drops in accordance with the fuel supply to the electronically controlled fuel injection apparatus 12, fuel is supplied by the fuel pump 22 from the fuel tank 10 to the fuel reservoir chamber 18 via the fuel introduction passage 20. When the height of the fuel level 34 in the fuel reservoir chamber 18 exceeds the height of the connecting position at which the fuel reservoir chamber 18 connects with the first fuel return passage 30, fuel overflows from the fuel reservoir chamber 18 via the first fuel return passage 30. Then, the overflowing fuel returns to the fuel tank 10.

When ambient temperature of an engine is high, vapor is generated in the fuel which is introduced into the fuel reservoir chamber 18 through the fuel introduction passage 20 or the fuel which is already stored in the fuel reservoir chamber 18. However, vapor is ejected above the fuel level 34 in the fuel reservoir chamber 18. Vapor ejected above the fuel level 34 returns from the fuel reservoir chamber 18 to the fuel tank 10 via the first fuel return passage 30.

When ambient temperature of an engine is high, vapor is also generated not only in the fuel which is stored in the fuel reservoir chamber 18 but also in the fuel which is flowing through the fuel supply passage 24. Most vapor which is contained in the fuel stored in the fuel reservoir chamber 18 is ejected above the fuel level 34. However, there is some vapor in the fuel flowing towards the upper fuel supply passage 24A (fuel supply passage 24) from the fuel reservoir chamber 18. Vapor which is contained in the fuel flowing from the fuel reservoir chamber 18 towards the electronically controlled fuel injection apparatus 12 via the fuel supply passage 24 is eliminated by the filter 26 in the filter body 28 which is disposed at the downstream side of the upper fuel supply passage 24A. Therefore, in principle, vapor is not contained in the fuel flowing from the filter 26 towards the lower fuel supply passage 24B. However, when ambient temperature of an engine is high, a slight amount of vapor is generated in the fuel flowing through the lower fuel supply passage 24B. Then, fuel which contains vapor is supplied to the electronically controlled fuel injection apparatus 12. Vapor contained in the fuel which is supplied to the electronically controlled fuel injection apparatus 12 is separated from fuel in the vapor separation chamber (not shown in drawings). Then, fuel from which vapor is eliminated is injected from the injection nozzle 16 of the electronically controlled fuel injection apparatus 12 into the intake passage 14.

Of the fuel which is supplied to the electronically controlled fuel injection apparatus 12, the fuel which was not injected from the injection nozzle 16 moves upwards in the second fuel return passage 36 (the fuel vapor return passage 40) as surplus fuel. Vapor which is contained in the fuel supplied to the electronically controlled fuel injection apparatus 12 also moves upwards in the second fuel return passage 36 (the fuel vapor return passage 40) being mixed with the surplus fuel.

A portion of the vapor return passage 42 is arranged to be higher than the fuel level 34 in the fuel reservoir chamber 18 before connecting to the fuel reservoir chamber 18. Therefore, in a non-operating state, fuel level 44 is formed in the vapor return passage 42 to be at the same height as the fuel level 34 in the fuel reservoir chamber 18. Although vapor is contained in the surplus fuel which is returned from the electronically controlled fuel injection apparatus 12 to the second fuel return passage 36, in a non-operating state, vapor is ejected above the fuel level 44 in the vapor return passage 42 and introduced above the fuel level 34 in the fuel reservoir chamber 18. Then, vapor which is introduced into the fuel reservoir chamber 18 returns to the fuel tank 10 via the first fuel return passage 30. Here, in an operating state, a part of the surplus fuel from the electronically controlled fuel injection apparatus 12 towards the second fuel return passage 36 returns to the fuel reservoir chamber 18 through the vapor return passage 42.

At some midpoint of the second fuel return passage 36, a portion is arranged to be higher than the connecting position of the fuel reservoir chamber 18 with the first fuel return passage 30. In the case that the second fuel return passage 36 connects with the fuel reservoir chamber 18, this structure prevents the fuel in the fuel reservoir chamber 18 from flowing into the second fuel return passage 36 so as not to disturb the returning of the surplus fuel which flows through the second fuel return passage 36 from the electronically controlled fuel injection apparatus 12. Further, in the case that the second fuel return passage 36 connects with the first fuel return passage 30, as shown in FIG. 3, the structure is so that the fuel which is returned to the fuel tank 10 via the first fuel return passage 30 after overflowing from the fuel reservoir chamber 18 does not disturb the returning of the surplus fuel which flows into and through the second fuel return passage 36 from the first fuel return passage 30.

The branch passage 38 branches from the second fuel return passage 36 which consists of the fuel vapor return passage 40 and the vapor return passage 42 located thereabove. The branch passage 38 extends downwards or horizontally towards the filter 26 from the position where it branches. Therefore, vapor which is contained in the surplus fuel moves upwards though the vapor return passage 42. Since the branch passage 38 is arranged to extend from the connecting position at which the branch passage 38 connects with the vapor return passage 42 downwards or horizontally towards the fitting position with the filter 26, in an operating state, fuel which does not contain vapor is introduced to the branch passage 38. The surplus fuel which flows into the branch passage 38 and does not contain vapor reaches the inner space 32, and then, is introduced to the lower fuel supply passage 24B. In this manner, in an operating state, a part of the surplus fuel which had vapor eliminated is returned from the electronically controlled fuel injection apparatus 12 flows into the branch passage 38, and then, is introduced to the lower fuel supply passage 24B via the inner space 32 of the filter 26. In this manner, a part of the surplus fuel which is returned from the electronically controlled fuel injection apparatus 12 is introduced to the fuel supply passage 24 from the branch passage 38, and can be re-supplied in a circulatory manner for a short distance. Since the re-supplied fuel in a circulatory manner flows from the branch passage 38 to the inner space 32 of the filter 26, vapor is not mixed into the re-supplied fuel in a circulatory manner. By re-supplying a part of the surplus fuel in a circulatory manner for a short distance, the amount of fuel which is returned to the fuel tank 10 can be reduced. Therefore, compared with the system which returns all the surplus fuel ejected from the electronically controlled fuel injection apparatus 12 to the fuel tank 10, power consumption of the fuel pump 22 can be decreased.

The surplus fuel which does not contain vapor flowing through the branch passage 38 flows from the inner space 28 of the filter 26 towards the lower fuel supply passage 24B. The flow of the surplus fuel through the inner space 28 induces flow of the supply fuel from the outside of the filter 26 towards the inner space 28. Namely, even when vapor is accumulated at the filter 26 and generates resistance against the fuel flow for passing through the filter 26 in the thickness direction, the flow of the supply fuel to pass through the filter 26 in the thickness direction can be smoothed by the flow of the surplus fuel through the inner space 28.

In the branch passage 38, the connecting position at which the branch passage 38 connects with the second fuel return passage 36 is the highest position, and the fitting position at which the branch passage 38 fits with the inner space 32 of the filter 26 is the lowest position. Further, in the inner space 32 of the filter 26, in principle, the side of the connecting position at which the inner space 32 connects with the branch passage 38 is the highest position, and the connecting side at which the space 32 connects with the lower fuel supply passage 24B is the lowest position. Furthermore, in the lower fuel supply passage 24B, the connecting position with the filter 26 is the highest position, and the connecting position at which the lower fuel supply passage 24B connects with the electronically controlled fuel injection apparatus 12 is the lowest position. For each of the branch passage 38, the inner space 32 of the filter 26 and the lower fuel supply passage 24B, the range from the respective highest position to the respective lowest position does not have a portion that rises. As a result, in a non-operating state at high temperature, even when vapor is generated in the fuel anywhere in the branch passage 38, the inner space 32 of the filter 26 or the lower fuel supply passage 24B, vapor moves upwards from the lower position to the higher position. Then, vapor can be ejected from the branch passage 38 to the vapor return passage 42. Then, vapor is ejected from the vapor return passage 42 above the fuel level 34 in the fuel reservoir chamber 18, and can be returned to the fuel tank 10 via the first fuel return passage 30. Namely, in the condition that a part of the surplus fuel is re-supplied in a circulatory manner via the branch passage 38, even when vapor is generated anywhere in the circulation route in a non-operating state, vapor can be returned to the fuel tank 10 from the vapor return passage 42 via the fuel reservoir chamber 18 and the first fuel return passage 30.

Figure 4:
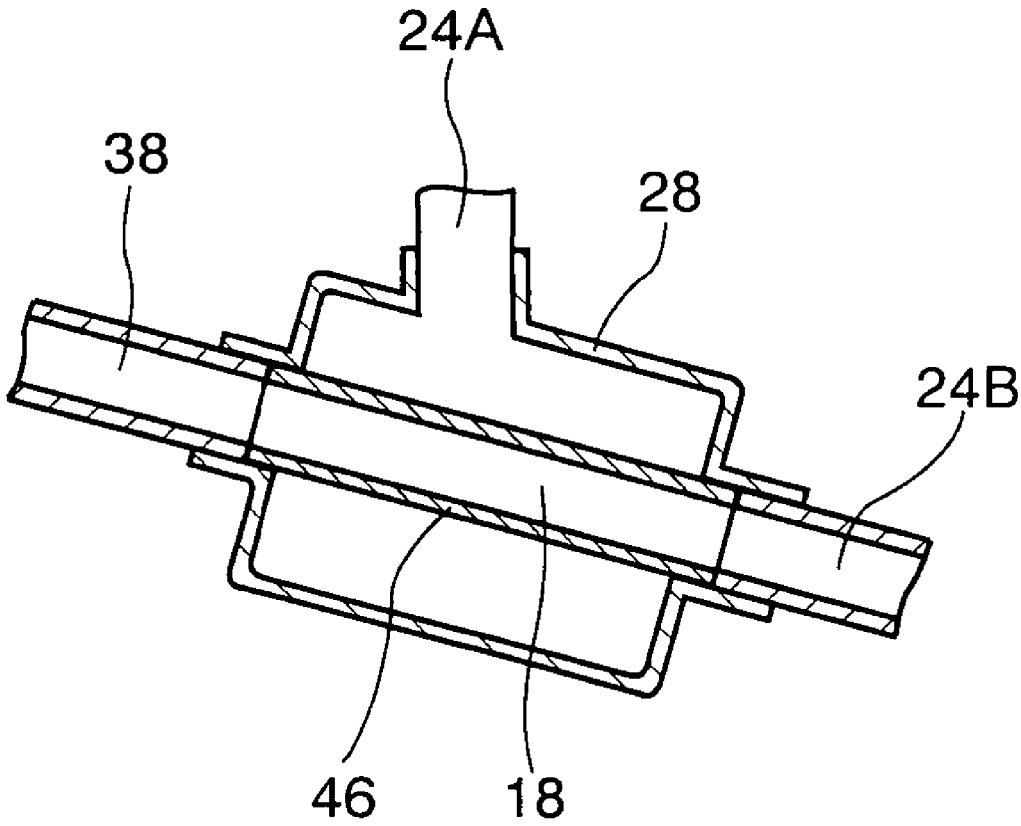
FIG. 4 is a sectional view of a modified embodiment of a filter body and a filter shown in FIG. 2.

Here, in FIG. 2, the top end of the branch passage 38 is shaped to be fitted into the cylindrical filter 26. However, as shown in FIG. 4, it is also possible to adopt a structure that the end surface of the cylindrical filter 46 abuts the end surface of the branch passage 38 so as to connect the branch passage 38 and the inner space 48 of the filter 46. Further, the branch passage 38 is not limited to be merged at the position of the filter 46. The circulation route can also be formed by merging the branch passage 38 with the fuel supply passage 24. In the case that the branch passage 38 is merged with the filter 26, 46, the sealing at the connecting position can be improved, and the manufacturing cost thereof can be reduced.

Figure 5:
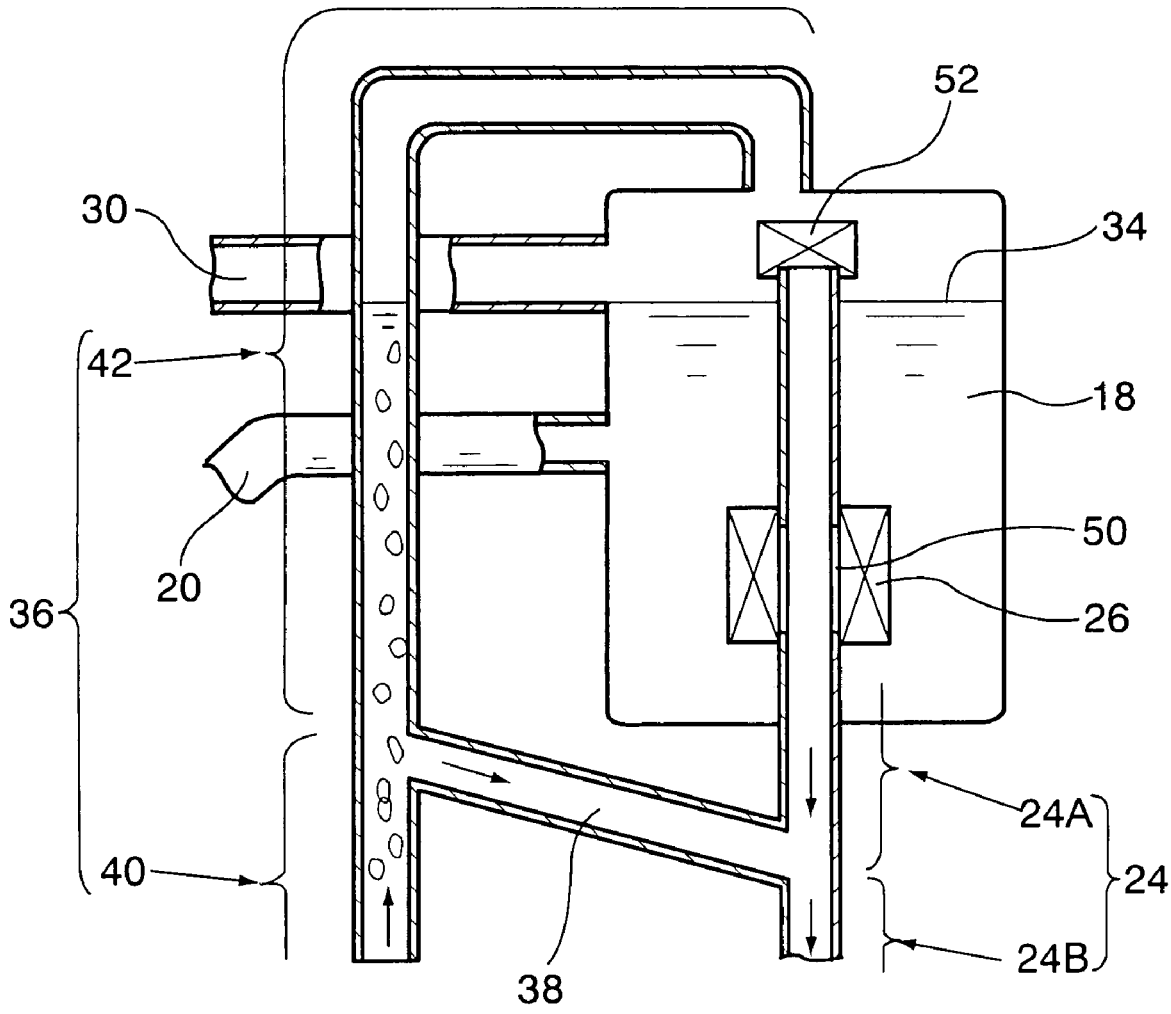
FIG. 5 is a sectional view of another modified embodiment of FIG. 2.

Here, in FIG. 1 and FIG. 2, the filter body 28 is disposed at some midpoint of the fuel supply passage 24 which is located below the fuel reservoir chamber 18, and the cylindrical filter 26 is disposed in the filter body 28, and the top end of the branch passage 38 is shaped to be fitted into the cylindrical filter 26. A modified embodiment as shown in FIG. 5 can also be possible. With this embodiment, the filter body 28 as shown in FIG. 1 and FIG. 2 is eliminated. The upper portion of the fuel supply passage 24 projects and opens above the fuel level 34 in the fuel reservoir chamber 18. A fuel inlet opening 50 is formed at some midpoint of the fuel supply passage 24 which is located below the fuel level 34 in the fuel reservoir chamber 18. The cylindrical filter 26 is attached to the fuel supply passage 24 so as to cover the fuel inlet opening 50. A filter 52 which captures foreign particles while allowing vapor to pass through is disposed at the opening of the fuel supply passage 24 which projects above the fuel level 34. The filter 52 is provided for preventing fuel which contains foreign particles in the fuel reservoir chamber 18 from flowing into the electronically controlled fuel injection apparatus 12 through the fuel supply passage 24, when a roll-over of a vehicle occurs.

With the fuel injection system shown in FIG. 5, fuel in the fuel reservoir chamber 18 reaches inside the fuel supply passage 24 from the fuel inlet opening 50 after passing through the filter 26. Foreign particles are eliminated from the fuel flowing into the fuel supply passage 24 by the filter 26. In this fuel injection system, the upper opening of the fuel supply passage 24 is formed above the fuel level 34 in the fuel reservoir chamber 18. With this structure, even when vapor is generated in the fuel supply passage 24 in a non-operating state, vapor can be ejected above the fuel level 34 in the fuel reservoir chamber 18 through the fuel supply passage 24. Therefore, ease of restarting can be improved by preventing vapor from accumulating at the fuel supply passage 24.

The Second Embodiment

Next, another embodiment of the present invention is explained with reference to the drawings.

Figure 6:
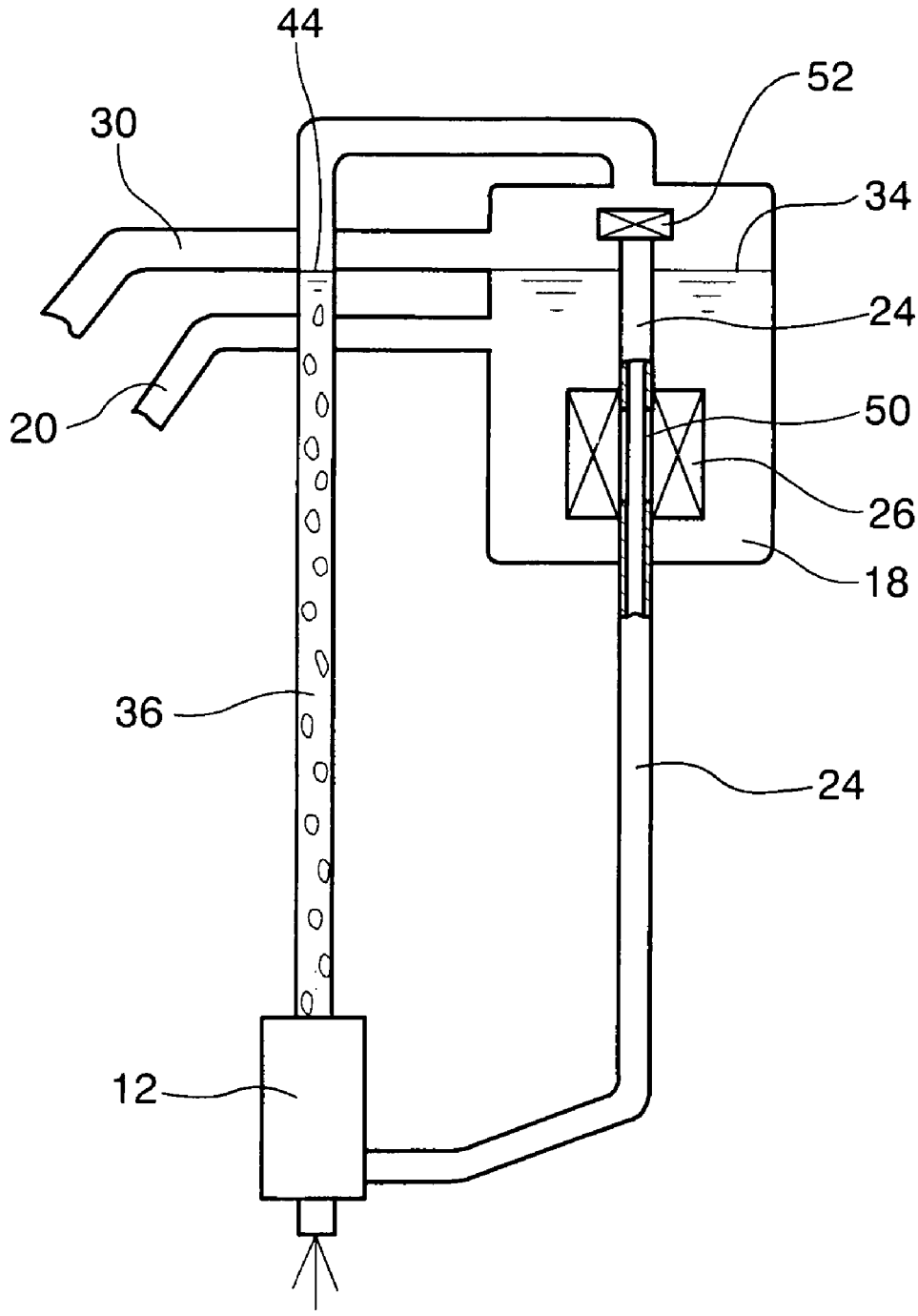
FIG. 6 is a schematic drawing showing a second embodiment of a fuel injection system of the present invention.

FIG. 6 is a schematic drawing of the second embodiment of a fuel injection system of the present invention. In FIG. 6, the same reference numbers as in FIG. 1, FIG. 2 and FIG. 5 represent the same members. In the second embodiment, the fuel tank (shown in FIG. 1) is located below the electronically controlled fuel injection apparatus 12, and the fuel reservoir chamber 18 is disposed above the electronically controlled fuel injection apparatus 12, as in the first embodiment. The fuel introduction passage 20 which is connected to the fuel tank 10 is connected at a mid-height of the fuel reservoir chamber 18. The fuel reservoir chamber 18 and the electronically controlled fuel injection apparatus 12 are connected by the fuel supply passage 24. The upper portion of the fuel supply passage 24 projects and opens above the fuel level 34 in the fuel reservoir chamber 18. The fuel inlet opening 50 is formed at some midpoint of the fuel supply passage 24 which is located below the fuel level 34 in the fuel reservoir chamber 18. The cylindrical filter 26 is attached to the fuel supply passage 24 so as to cover the fuel inlet opening 50. The filter 52 which captures foreign particles while allowing vapor to pass through is disposed at the top end of the fuel supply passage 24 which projects above the fuel level 34 in the fuel reservoir chamber 18. The upper position of the fuel reservoir chamber 18 and the fuel tank (shown in FIG. 1) are connected by the first fuel return passage 30. Further, the electronically controlled fuel injection apparatus 12 and the upper position of the fuel reservoir chamber 18 (the position higher than the connecting position at which the reservoir chamber 18 connects with the first fuel return passage 30) are connected by the second fuel return passage 36.

The second embodiment is different from the first embodiment in that the branch passage 38 of the first embodiment is eliminated. As a result, the second fuel return passage 36 connects only with the upper position of the fuel reservoir chamber 18. Therefore, in an operating state, the surplus fuel which contains vapor from the electronically controlled fuel injection apparatus 12 always returns to the fuel reservoir chamber 18 through the second fuel return passage 36. In a non-operating state, the fuel level 44 is formed in the second fuel return passage 36.

With the second embodiment, as with the first embodiment, fuel is supplied to the electronically controlled injection apparatus 12 from the fuel reservoir chamber 18 via the fuel supply passage 24 by head difference. The surplus fuel which contains vapor from the electronically controlled fuel injection apparatus 12 returns to the fuel reservoir chamber 18 via the second fuel return passage 36, and returns to the fuel tank 10 from the fuel reservoir chamber 18 via the first fuel return passage 30. Further, even when vapor is generated in the second fuel return passage 36 in a non-operating state, vapor returns from the second fuel return passage 36 to the fuel tank 10 via the fuel reservoir chamber 18 and the first fuel return passage 30. On the other hand, when vapor is generated in the fuel supply passage 24 in a non-operating state, vapor moves upwards in the fuel supply passage 24, and reaches above the fuel level 34 in the fuel reservoir chamber 18 via the filter 52 through which vapor passes. Then, vapor returns to the fuel tank 10 via the first fuel return passage 30.

What is claimed is:

1. A fuel injection system, comprising:

a fuel tank;

an electronically controlled fuel injection apparatus which is located above said fuel tank;

a fuel reservoir chamber which is located above said electronically controlled fuel injection apparatus;

a fuel introduction passage which connects said fuel tank and said fuel reservoir chamber;

a fuel pump which introduces fuel from said fuel tank to said fuel reservoir chamber via said fuel introduction passage;

a first fuel return passage which connects said fuel reservoir chamber and said fuel tank, and returns fuel overflowing from said fuel reservoir chamber and vapor to said fuel tank, said first fuel return passage connecting with said fuel reservoir chamber at a first connecting position;

a fuel supply passage which connects said fuel reservoir chamber and said electronically controlled fuel injection apparatus;

a filter arranged upstream of said electronically controlled fuel injection apparatus in said fuel supply passage for eliminating vapor from fuel passing through said fuel supply passage prior to entry of the fuel into said electronically controlled fuel injection apparatus; and a second fuel return passage connecting said electronically controlled fuel injection apparatus with said fuel reservoir chamber, said second fuel return passage having a portion disposed higher than said first connecting position.

2. The fuel injection system according to claim 1, wherein said filter has an inner space formed therein;

a branch passage branches from some midpoint of said second fuel return passage at a branching position disposed below said first connecting position ; and said branch passage and said fuel supply passage are connected with said inner space of said filter, and said branch passage is horizontal or declined from said branching position at which said branch passage connects towards a second connecting position with said inner space of said filter.

3. The fuel injection system according to claim 2, wherein in a route from said branching position through said branch passage and said inner space of said filter to third connecting position at which said inner space connects with said fuel supply passage on a downstream side of said filter, said branching position is the highest position, and said third connecting position is the lowest position; and said route from said branching position to said third connecting position does not have a portion that declines in a direction from said branching position toward said third connecting position.

4. The fuel injection system according to claim 2, wherein an inner diameter of said second fuel return passage above said branching position is equal to or larger than 12 millimeters.

5. The fuel injection system according to claim 4, wherein an inner diameter of said second fuel return passage below said branching position is smaller than the inner diameter of said second fuel return passage above said branching position.

6. The fuel injection system according to claim 1, wherein a filter which does not allow foreign particles to pass through but allows vapor to pass through is disposed at said second fuel return passage above said first connecting position.

7. A fuel injection system, comprising:

a fuel tank;

an electronically controlled fuel injection apparatus which is located above said fuel tank;

a fuel reservoir chamber which is located above said electronically controlled fuel injection apparatus;

a fuel introduction passage which connects said fuel tank and said fuel reservoir chamber;

a fuel pump which introduces fuel from said fuel tank to said fuel reservoir chamber via said fuel introduction passage;

a first fuel return passage which connects said fuel reservoir chamber and said fuel tank, and returns fuel overflowing from said fuel reservoir chamber and vapor to said fuel tank, said first fuel return passage connecting with said fuel reservoir chamber at a first connecting position;

a fuel supply passage which connects said fuel reservoir chamber and said electronically controlled fuel injection apparatus;

a filter arranged upstream of said electronically controlled fuel injection apparatus in said fuel supply passage for eliminating vapor from fuel passing through said fuel supply passage prior to entry of the fuel into said electronically controlled fuel injection apparatus; and a second fuel return passage connecting said electronically controlled fuel injection apparatus with said first fuel return passage, said second fuel return passage having a portion disposed higher than said first connecting position.

8. The fuel injection system according to claim 7, wherein said filter has an inner space formed therein;

a branch passage branches from some midpoint of said second fuel return passage at a branching position disposed below said first connecting position ; and said branch passage and said fuel supply passage are connected with said inner space of said filter, and said branch passage is horizontal or declined from said branching position at which said branch passage connects towards a second connecting position with said inner space of said filter.

9. The fuel injection system according to claim 8, wherein in a route from said branching position through said branch passage and said inner space of said filter to third connecting position at which said inner space connects with said fuel supply passage on a downstream side of said filter, said branching position is the highest position, and said third connecting position is the lowest position; and said route from said branching position to said third connecting position does not have a portion that declines in a direction from said branching position toward said third connecting position.

10. The fuel injection system according to claim 8, wherein an inner diameter of said second fuel return passage above said branching position is equal to or larger than 12 millimeters.

11. The fuel injection system according to claim 10, wherein an inner diameter of said second fuel return passage below said branching position is smaller than the inner diameter of said second fuel return passage above said branching position.

12. The fuel injection system according to claim 7, wherein a filter which does not allow foreign particles to pass through but allows vapor to pass through is disposed at said second fuel return passage above said first connecting position.

13. A fuel injection system, comprising:

a fuel tank;

an electronically controlled fuel injection apparatus which is located above said fuel tank;

a fuel reservoir chamber which is located above said electronically controlled fuel injection apparatus;

a fuel introduction passage which connects said fuel tank and said fuel reservoir chamber;

a fuel pump which introduces fuel from said fuel tank to said fuel reservoir chamber via said fuel introduction passage;

a first fuel return passage which connects said fuel reservoir chamber and said fuel tank, and returns fuel overflowing from said fuel reservoir chamber and vapor to said fuel tank, said first fuel return passage connecting with said fuel reservoir chamber at a first connecting position;

a fuel supply passage which connects said fuel reservoir chamber and said electronically controlled fuel injection apparatus;

a filter arranged upstream of said electronically controlled fuel injection apparatus in said fuel reservoir chamber for eliminating vapor from fuel passing through said fuel supply passage prior to entry of the fuel into said electronically controlled fuel injection apparatus; and a second fuel return passage connecting said electronically controlled fuel injection apparatus with said fuel reservoir chamber, said second fuel return passage having a portion disposed higher than said first connecting position.

14. The fuel injection system according to claim 13, wherein said fuel supply passage projects above a fuel level location in said fuel reservoir chamber, said fuel supply passage includes an opening that opens into said fuel reservoir chamber above the fuel level location, said fuel supply passage includes a fuel inlet opening which opens into a said fuel reservoir chamber below the fuel level location, and said fuel inlet opening is covered by said filter.

15. The fuel injection system according to claim 14, wherein a filter which does not allow foreign particles to pass through but allows vapor to pass through is attached to said opening of said fuel supply passage that opens into said fuel reservoir chamber above the fuel level location.

16. The fuel injection system according to claim 13, wherein a filter which does not allow foreign particles to pass through but allows vapor to pass through is disposed at said second fuel return passage above said first connecting position.

17. A fuel injection system, comprising:

a fuel tank;

an electronically controlled fuel injection apparatus which is located above said fuel tank;

a fuel reservoir chamber which is located above said electronically controlled fuel injection apparatus;

a fuel introduction passage which connects said fuel tank and said fuel reservoir chamber;

a fuel pump which introduces fuel from said fuel tank to said fuel reservoir chamber via said fuel introduction passage;

a first fuel return passage which connects said fuel reservoir chamber and said fuel tank, and returns fuel overflowing from said fuel reservoir chamber and vapor to said fuel tank, said first fuel return passage connecting with said fuel reservoir chamber at a first connecting position;

a fuel supply passage which connects said fuel reservoir chamber and said electronically controlled fuel injection apparatus;

a filter arranged upstream of said electronically controlled fuel injection apparatus in said fuel reservoir chamber for eliminating vapor from fuel passing through said fuel supply passage prior to entry of the fuel into said electronically controlled fuel injection apparatus; and a second fuel return passage connecting said electronically controlled fuel injection apparatus with said first fuel return passage, said second fuel return passage having a portion disposed higher than said first connecting position.

18. The fuel injection system according to claim 17, wherein a filter which does not allow foreign particles to pass through but allows vapor to pass through is disposed at said second fuel return passage above said first connecting position.

19. The fuel injection system according to claim 17, wherein said fuel supply passage projects above a fuel level location in said fuel reservoir chamber, said fuel supply passage includes an opening that opens into said fuel reservoir chamber above the fuel level location, said fuel supply passage includes a fuel inlet opening which opens into a said fuel reservoir chamber below the fuel level location, and said fuel inlet opening is covered by said filter.

20. The fuel injection system according to claim 19, wherein a filter which does not allow foreign particles to pass through but allows vapor to pass through is attached to said opening of said fuel supply passage that opens into said fuel reservoir chamber above the fuel level location.

* * * * *